US007455418B1

(12) United States Patent
Graham

(10) Patent No.: US 7,455,418 B1
(45) Date of Patent: Nov. 25, 2008

(54) REFLECTIVE/GLOW IN THE DARK SAFETY BAND

(76) Inventor: Hazel Graham, 3312 NW. 23rd St., Lauderdale Lakes, FL (US) 33311

( * ) Notice: Subject to any disclaimer, the term of this patent is extended or adjusted under 35 U.S.C. 154(b) by 260 days.

(21) Appl. No.: 11/416,267

(22) Filed: May 1, 2006

(51) Int. Cl.
*F21V 33/00* (2006.01)

(52) U.S. Cl. ..... 362/103; 362/105; 362/84

(58) Field of Classification Search ..... 362/103, 362/104, 105, 106, 107, 108, 34, 84
See application file for complete search history.

(56) References Cited

U.S. PATENT DOCUMENTS

| | | | | | |
|---|---|---|---|---|---|
| 5,695,853 | A * | 12/1997 | Billingsley et al. | ..... | 428/171 |
| 5,914,197 | A * | 6/1999 | Goudjil | ..... | 428/537.5 |
| 6,106,129 | A * | 8/2000 | Cranor et al. | ..... | 362/34 |
| 6,146,006 | A * | 11/2000 | Cross | ..... | 362/555 |
| 6,859,941 | B2 * | 3/2005 | Koppes | ..... | 2/81 |
| 2003/0196251 | A1 * | 10/2003 | Lee | ..... | 2/244 |

* cited by examiner

*Primary Examiner*—Thomas M Sember

(57) ABSTRACT

A reflective/glow in the dark safety band formed by either a single layer, or a double layer of fabric or plastic which can be worn on users head, wrist, or ankle providing reflective and glow in the dark characteristics to enhance safety for the person who participate in sport activities at nighttime.

11 Claims, 4 Drawing Sheets

REFLECTIVE/GLOW IN THE DARK SAFETY BAND

FIELD OF THE INVENTION

The present invention generally relates to a safety-clothing item for a person to wear participating in outdoor sports in the dark, and more particularly, relates to a reflective/glow in the dark headband, wristband, or ankle band for a person to wear in the dark when participating in running, jogging or other sports activities.

BACKGROUND OF THE INVENTION

Running, jogging, skating, and bicycling are popular sporting activities practiced by a large number of people for maintaining physical fitness and muscle tuning. These activities, when conducted outdoors, may become hazardous to the person when there is not sufficient daylight. For instance, when such activities are conducted in the early morning, after sun down, or at nighttime. It would be desirable if the presence of the person can be more visible to others, especially to those operating motor vehicles. Previously, reflective bands or strips have been used by runners, joggers, or bicyclists by attaching such bands or stripes to their clothing, for instance, on the arm or to the chest and back.

However, the existing reflective safety bands or strips must be sewn to a clothing item, such as to the runners jacket and therefore, may not be readily available when a change of clothing occurs. Moreover, the reflective bands or strips may not be completely efficient when it is very dark outdoors and when there is no light to be reflected.

It is therefore an object of the present invention to provide reflective/glow in the dark safety bands that do not have the drawbacks or shortcomings of the conventional reflective bands or strips.

It is another object of the present invention to provide reflective/glow in the dark safety bands that are elastic such that they do not need to be sewn to a clothing item.

It is a further object of the present invention to provide reflective/glow in the dark safety bands that can be readily warn on the body of a person while running, jogging, skating, or bicycling.

It is another further object of the present invention to provide reflective/glow in the dark safety bands that glows in complete darkness without any light source.

It is yet another object of the present invention to provide reflective/glow in the dark safety bands that are in the form of head band, wrist band, ankle band, or socks.

SUMMARY OF THE INVENTION

In accordance with the present invention, reflective/glow in the dark safety band that not only reflects light but also glows in complete darkness is provided.

The present invention reflective/glow in the dark safety band can be constructed by a first section that is formed in an annular ring which has an outer surface, the outer surface further includes at least one reflective annual ring and at least one glow in the dark ring; and a second section formed of an elastic material attached to the first section providing a tight fit on a human body part.

BRIEF DESCRIPTION OF THE DRAWINGS

Other objects, features and advantages of the invention will become apparent to one skilled in the art by reading the following specification and subjoined claims and by referencing the following drawings, in which:

DETAILED DESCRIPTION OF THE PREFERRED AND ALTERNATE EMBODIMENTS

Figure 1:
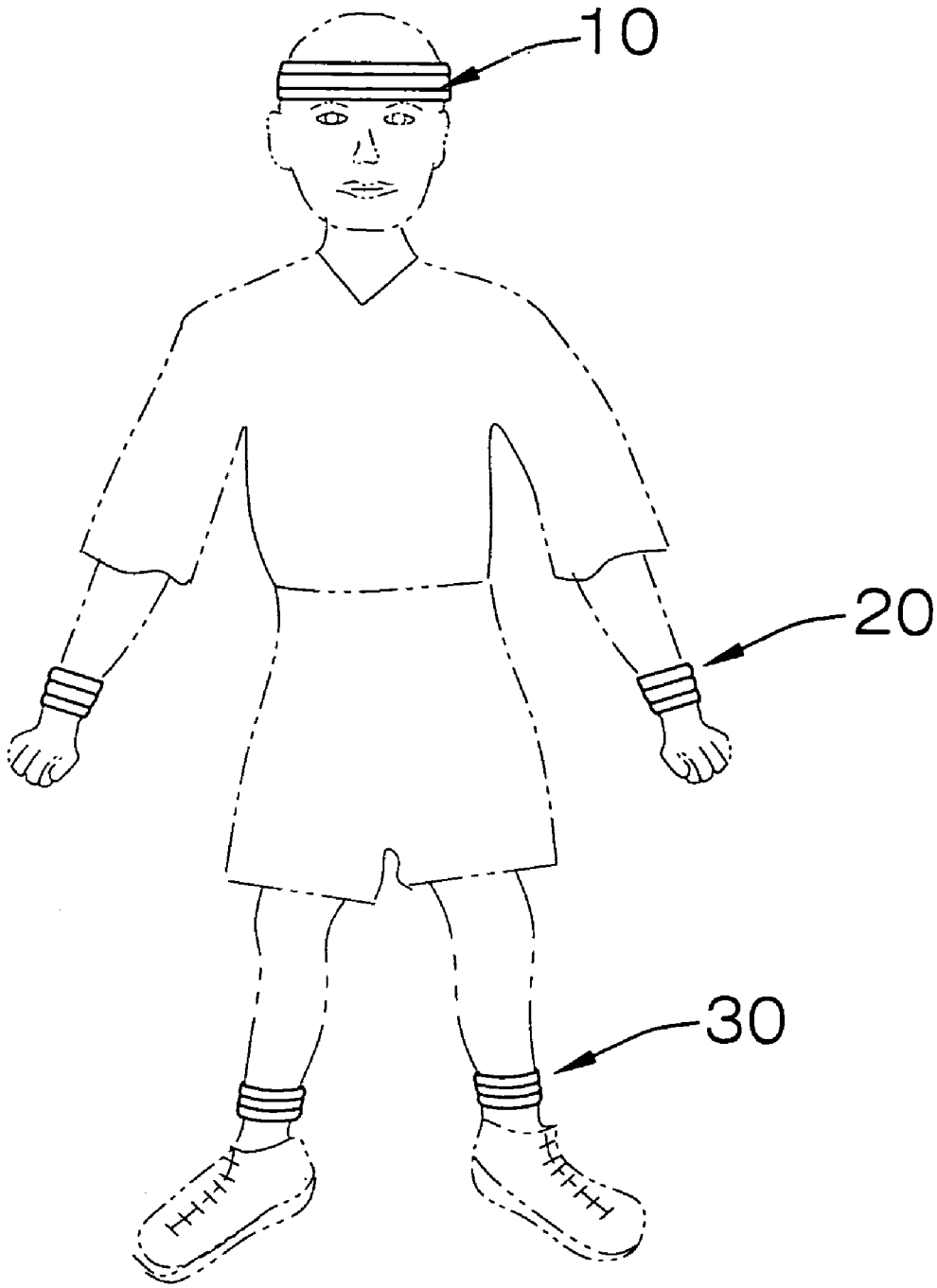
FIG. 1 is a plane view of the present invention headband, wristband, and ankle band being worn by a person.

The present invention discloses a reflective/glow in the dark safety band that can be worn on the wrist, on the head, or on the ankle of a person engaging in running, jogging, skating, or bicycling in the dark for enhancing the safety of the person.

The present invention reflective/glow in the dark safety bands provide a new line of garments and accessories for individuals who enjoy outdoor fitness and sports activities such as walking, jogging, inline skating, bicycling, ect. The reflective/glow in the dark safety band features a reflective/glow in the dark design that would make individuals more visible, particularly during evening and nighttime hours, thereby enhancing safety.

The reflective/glow in the dark safety band consists of a series of sport accessories and garments, including a headband, wristband, and ankle band or socks. The garments can be produced from cotton or polyester materials and would likely feature sections of elasticized material to provide a snug, form-fitting design. Each unit would include strips of a reflective vinyl or plastic material incorporated into the exterior. These strips of material would reflect the light from streetlights, vehicle headlights, and other such light sources. The safety band further include a section that would glow in the dark due to the fluorescent dye used on the fabric or as a coating such that the band would glow in the dark even when there is no light sources.

The present invention safety band can be offered in a variety of sizes, as well as in a range of colors. The reflective and glow in the dark materials can be arranged on the socks and other accessories in various patterns. When the present invention safety bands are worn on a person who participate in an outdoor fitness activity such as running, walking, inline skating, bicycling ect, the strips of reflective and glow in the dark materials on the safety bands would become illuminated when struck by light from motor vehicles, street lamps, ect. The glow in the dark material would emit lights in the fluorescent range even when there is no such light sources. The individual who wears the safety bands therefore becomes more visible during the evening, nighttime, early morning hours and thus enhancing safety of the individual.

The appealing features of the present invention safety bands is its convenience, ease of use, small size, unobtrusiveness, highly visible design, and ability to enhance safety. The safety bands make individuals who enjoy participating in fitness or recreation activities more visible during nighttime hours. The strips of reflective material on the head band, wrist band, and socks would reflect light from motor vehicles, street lamps and other light sources, and thus making wearer more visible from a distance, particularly during the evening, nighttime, and early morning hours. This would prevent collisions between motorists and fitness or sports enthusiasts, such as individuals who would run, walk, or jog, as well as skate boarders, bicyclists, and inline skaters. It will thus reduce the risks of accidents due to low or poor visibility and prevent serious injuries and fatalities among fitness enthusiasts.

The present invention safety bands may also be worn by neighborhood children during a wide variety of outdoor activities. Not only would they allow parents to quickly and easily spot their children at night, but it would allow motorists who may be driving on neighborhood streets to see children and avoid tragic accidents. The safety bands feature small, compact, and unobtrusive designs that would not hinder an individuals ability to participate in a fitness, sport, or recreational activity. It is also a more cost-effective alternative to purchasing new shoes or other equipment that may reflect lights.

Figure 2:
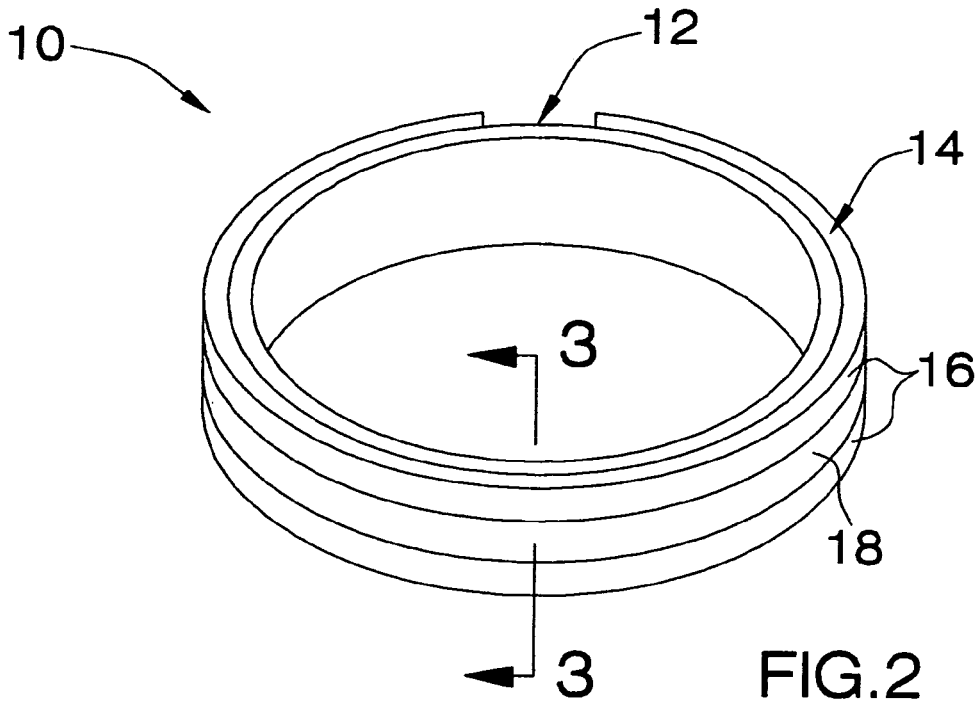
FIG. 2 is a perspective view of the preferred embodiment of the present invention headband.

Referring initially to FIG. 1, wherein a plane view of a person wearing the present invention safety bands is shown. The individual is wearing a headband 10, two wristbands 20, and two ankle bands, or socks, 30. A more detailed view shown in a perspective view of the headband 10 is shown in FIG. 2. The headband 10 is formed in an annular shape with an inner band 12 and an outer band 14. The inner band 12 may be suitably formed of a stretch fabric, such as one formed with elastic yarns.

Figure 3:
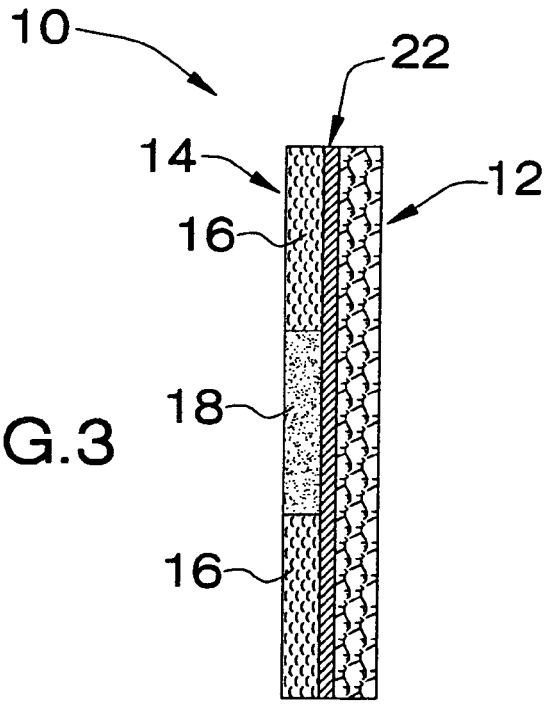
FIG. 3 is a cross-sectional view of the present invention headband in FIG. 2.

The outer band 14 can be suitably formed with two reflective strips 16 on the outside and a middle strip 18 formed of a glow in the dark material. A cross-sectional view of the headband 10 is shown in FIG. 3. Also shown in FIG. 3 is a bounding layer 22 which is normally a thin adhesive layer for bonding the inner band 12 to the outer band 14. It should be noted that the glow in the dark strip 18 is formed either of a fabric or of a plastic material that contains, or is coated with a fluorescent dye which absorbs light and then emits light in total darkness. The two reflective strips 16 reflects light such as that from street lamps or automobile head lights. The present invention safety band, such as the headband 10 shown in FIGS. 2 and 3 can therefore been seen in complete darkness when there is no light.

Figure 4:
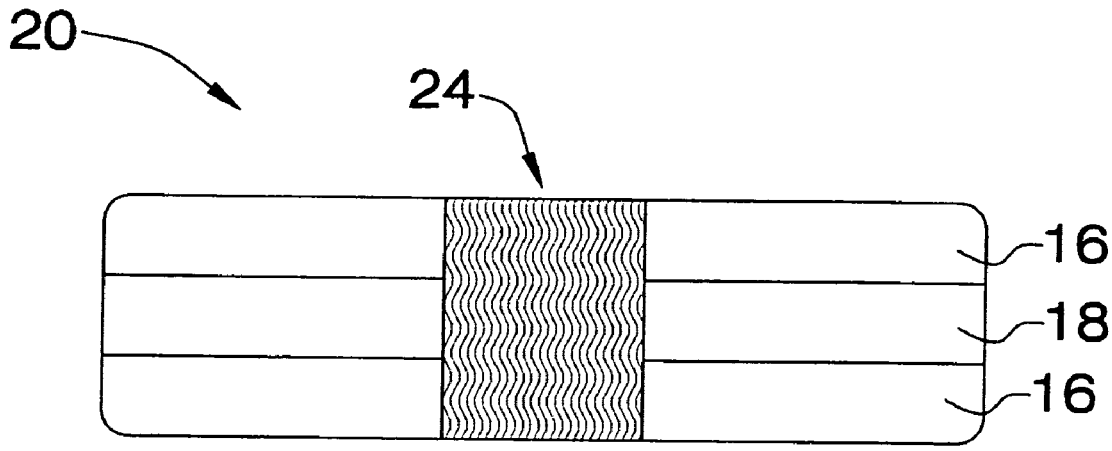
FIG. 4 is a plane view of an alternate embodiment of the present invention wristband.

In an alternate embodiment, the present invention wristband 20 is shown in FIG. 4 which consists of a section 24 of the band formed of an elastic, stretch fabric material. In this alternate embodiment wrist band 20, there is only a single layer of the outer band which consists of the stretch fabric section 24, and there is no need for an inner band that would have been formed of a stretch fabric. Similarly, wristband 20 may be formed of a strip of glow in the dark fabric or plastic 18, and two alternate strips 16 of reflective material.

Figure 5:
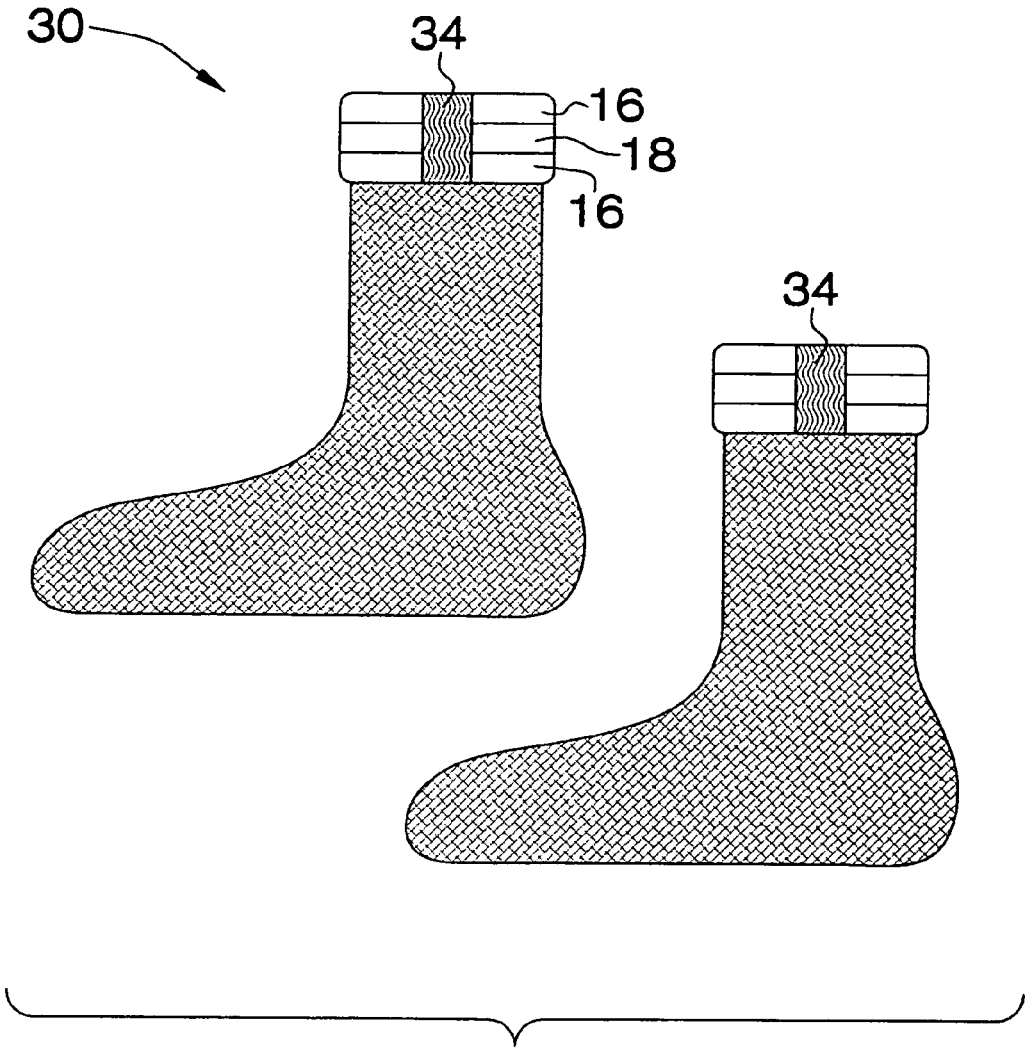
FIG. 5 is a plane view of the alternate embodiment of the present invention ankle band or socks.

A similar alternate embodiment for a sock or an ankle band 30 is shown in FIG. 5 which also contains a section of stretch fabric 34. The ankle band can be formed to be worn on the users ankle, or can be formed as part of the sock as shown in FIG. 5.

The present invention reflective/glow in the dark safety bands have therefore been amply described in the above descriptions and in the appended drawing of FIGS. 1-5.

Those skilled in the art can now appreciate from the foregoing description that the broad teachings of the present invention can be implemented in a variety of forms. Therefore, while this invention has been described in connection with a particular example thereof, the true scope of the invention should not be so limited since other modifications will become apparent to the skilled practitioner upon a study of the drawings, specification and claims that follow.

The invention claimed is:

1. A reflective/glow in the dark safety band comprising:

a first section formed in an annular ring having an outer surface, said outer surface further comprising at least one reflective annular ring and at least one glow in the dark ring; and a second section formed in an annular ring of an elastic material attached to an inside surface of said first section providing a tight fit on a human body part.

2. The reflective/glow in the dark safety band according to claim 1, wherein said second section is a length forming a part of said first section.

3. The reflective/glow in the dark safety band according to claim 1, wherein said first section, and said section are concentric annular rings.

4. The reflective/glow in the dark safety band according to claim 1, wherein said first section and said second section form a single concentric ring.

5. The reflective/glow in the dark safety band according to claim 1 further comprising a bonding layer in between said first section and said second section.

6. The reflective/glow in the dark safety band according to claim 1 further comprising an adhesive layer between said first section and said second section.

7. The reflective/glow in the dark safety band according to claim 1, wherein said glow in the dark ring is formed of plastic or fabric containing fluorescent dye.

8. The reflective/glow in the dark safety band according to claim 1, wherein said second section is formed of an elastic material that has an elongation of at least 20 percent.

9. The reflective/glow in the dark safety band according to claim 2, wherein said second section has a length of at least one inch.

10. The reflective/glow in the dark safety band according to claim 1, wherein said first section further comprising two reflective annular rings.

11. The reflective/glow in the dark safety band according to claim 1, wherein said first section further comprising two reflective annular rings and one glow in the dark ring situated in between said reflective annular rings.

* * * * *